United States Patent [19]

Knappstein et al.

[11] 4,197,165

[45] Apr. 8, 1980

[54] BUNKER CONSTRUCTION FOR CHARGING HOT, DRY COAL AND COLD, WET COAL TO COKE OVEN CHARGING HOPPERS

[75] Inventors: Johannes Knappstein; Janos Bocsanczy, both of Recklinghausen, Fed. Rep. of Germany

[73] Assignee: Firma Carl Still Recklinghausen, Fed. Rep. of Germany

[21] Appl. No.: 933,953

[22] Filed: Aug. 15, 1978

[30] Foreign Application Priority Data

Aug. 27, 1977 [DE] Fed. Rep. of Germany ..... 2738761

[51] Int. Cl.[2] ..... C10B 31/04

[52] U.S. Cl. ..... 202/262

[58] Field of Search ..... 202/262, 263; 201/40; 214/35 R

[56] References Cited

U.S. PATENT DOCUMENTS 3,198,623 8/1965 Evans et al. ..... 214/35 R X 4,024,024 5/1977 Knappstein ..... 202/262

FOREIGN PATENT DOCUMENTS 778754 7/1957 United Kingdom ..... 202/262

*Primary Examiner*—Arnold Turk

*Attorney, Agent, or Firm*—McGlew and Tuttle

[57] ABSTRACT

Bunker for supplying alternatively either hot, dry coal or cold, wet coal to a charging hopper or test bunkers of a plurality of coke ovens in a coke oven battery, comprises, a bunker housing having an inlet adjacent its top for charging coal and a lower portion with a plurality of downwardly opening coke oven discharge spouts corresponding to the number of charging hoppers and test bunkers. An inert gas feed line includes a portion branching off to the vicinity of each spout and provided with a plurality of feeder lines at the lower end of the spout and which also includes a plurality of spray nozzles in the line for directing a water spray in the direction of the inert gas flow.

3 Claims, 1 Drawing Figure

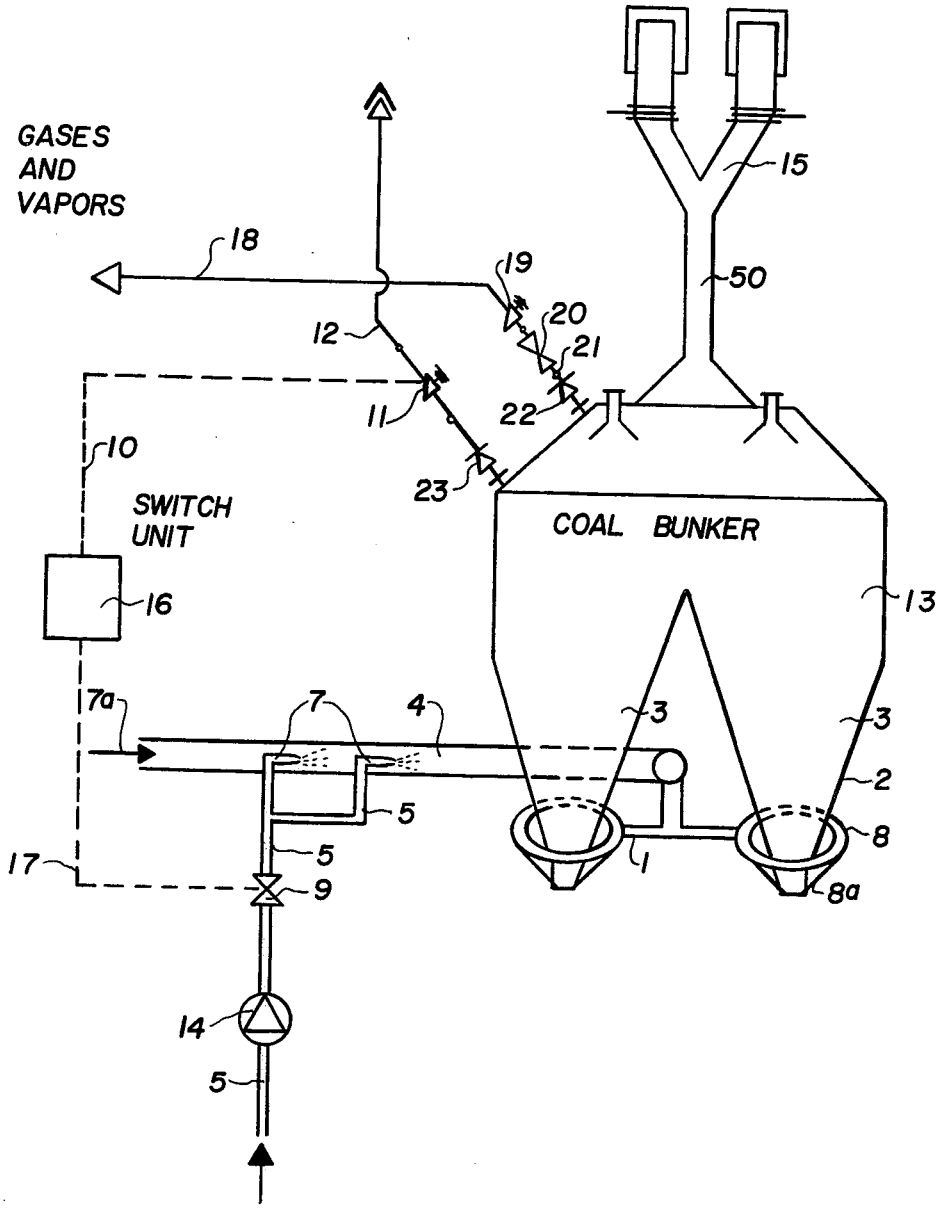
GASES
AND
VAPORS
18
19
20
21
22
23
12
11
10
SWITCH
UNIT
16
15
50
COAL BUNKER
13
7a
7
4
3
3
2
5
5
8
8a
1
17
9
14
5

BUNKER CONSTRUCTION FOR CHARGING HOT, DRY COAL AND COLD, WET COAL TO COKE OVEN CHARGING HOPPERS

FIELD AND BACKGROUND OF THE INVENTION

This invention relates to coke ovens in general and, in particular, to a new and useful group of bunkers for hot, dry coal and cold, wet coal for charging battery-arranged coke ovens, which have a number of outlets corresponding to the number of oven chamber charging hoppers, and which also have test bunkers arranged beneath them, and inert gas feeders and temperature and pressure controls, as well as inert gas downcomers.

DESCRIPTION OF THE PRIOR ART

Coal bunker groups for coking plants are known, for example, through the "Ress-Story of Coking Technology", Verlag Gluckauf GmbH, Essen, pg. 176, and have been provided in the course of technological developments with inert gas feeders, temperature and pressure controls, and gas downcomers primarily for avoiding coal fires or the fighting of fires already in progress.

The engineering devices of the known type of bunker group make it suitable for accommodating coal supplies for coking batteries, namely, this applies generally to so-called wet coking coal with a water content of, for example, 8% to 12%, and also, for well known reasons, to preheated and predried coking coal.

Special problems in connection with the coke oven operations are produced, however, if the bunker group according to given requirements is to serve selectively for both the storing of dry and wet coal, specifically the storage conversion from hot, dry coal to cold, wet coal.

Difficulties are produced by the fact that it is impossible to feed hot, dry coal to a residual quantity of cold, wet coal, because in this case, an oven chamber could be partially filled with wet coal and partially with dry coal.

Thereby, under specific conditions and with various coking times effective for wet and dry coal, when the coke is pushed out from the oven, either one part of the coke would still not be good at all, or the other part is over-refined and small. This results in difficult push-outs from the oven chamber with all of the well-known consequences, e.g., damaging of oven chamber walls.

It should be noted that an oven chamber must be charged with coal to at least 60% of its effective volume, in order to prevent the chamber walls in their upper area from becoming overheated and damaged during the coking period.

This means that on empty running of two bunkers for converting its operation from hot, dry coal to wet coal, there should always be a reserve left for the oven chamber to be charged last which corresponds to at least 60% of the charging or effective volume of an oven chamber. This requirement, however, can only be adhered to with extreme difficulty.

Reciprocally, on converting from wet coal to dry coal, this problem does not exist since with a bunker coal volume insufficiently maintained for an oven chamber, the amount lacking can be replenished by the wet coal which is always available.

However, a conversion from dry to wet coal is done mostly for reasons connected with operational breakdowns, and there is no guarantee at all that there is always a residual quantity present which is required for supplementing the charging of an entire oven chamber, unless an additional and expensive container for a reserve volume or for a runoff of the remaining bunker content is installed.

SUMMARY OF THE INVENTION

The present invention provides a bunker plant of the initially defined type to accomplish the operational conversion from dry, hot coal to wet coal with a continual complete charging of all oven chambers even without requiring an additional container.

In accordance with the invention, inert gas feeders are provided at the lower ends of the bunker outlets and the feeders are connected to an inert gas line, which, in turn, is connected to a water supply line. In addition, spray nozzles are provided at openings of the water supply line into the inert gas line to eject a water spray in the direction of the inert gas flow.

Another feasible arrangement is the provision of an automatic valve in the water supply line which is connected to a pressure gauge in the bunker waste gas line through a line and switching unit.

With a bunker plant developed according to the invention, it is possible, at any time, to whirl up residual amounts of hot, dry coal as well as the bunker plant charge itself, which is lower than an oven chamber filling, and to spray it with finely distributed water to the extent that, in its water content, it corresponds approximately to that of the subsequently supplied wet coal and is thereby also cooled off accordingly.

Furthermore, the bunker plant is advantageously connected with all of the known automatic safety devices, such as a bottom and top level indicator and is equipped with alarm installations or automatic switches for startup or shutoff of the feeder devices. The automation of the water supply as a function of bunker internal pressure substantially contributes to operational safety.

The bunker structure itself is considerably heated up by the hot coal, and if the water inflow is not controlled through internal pressure, a damaging type of pressure would develop. According to the invention, however, it is possible to cool off both the residual amount of coal and the bunker structure itself without any danger, i.e., without producing a substantial pressure effect.

With the development of a bunker installation according to the invention there is no difference between coking times of residual coal in the bunker and of the added wet coal. The type of oven chamber charge composed of a previously produced residual quantity of dry coal plus added wet coal results in a uniform oven charge as well as a uniform coke cake.

Accordingly, it is an object of the invention to provide a bunker for supplying either hot, dry coal or cold, wet coal to the charging hoppers or test bunkers of a plurality of coke ovens in a coke oven battery which comprises a bunker housing having an inlet adjacent its top for charging coal into the bunker and a lower portion with a plurality of downwardly opening coke oven discharge spouts corresponding to the number of charging hoppers and test bunkers and which also includes an inert gas line for supplying inert gas to the vicinity of the discharge spouts and which has means for directing a water spray into the inert gas in the direction of the gas flow.

A further object of the invention is to provide a bunker for charging hot, dry coal and cold, wet coal to coke oven charging hoppers which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a schematic view showing a coal bunker, constructed in accordance with the invention.

DESCRIPTION OF THE PREFERRED EMBODIMENT

Referring to the drawing in particular, the invention embodied therein, comprises, a coal bunker, generally designated 13, having an upper portion which is connected through one or more charging lines 50 to a coal-charging device 15. The bunker 13 includes lower portions with a plurality of downspouts 3 terminating at their lower ends with discharges of a number corresponding to the number of oven chamber charging hoppers and test bunkers which are adapted to be disposed beneath them.

In accordance with the invention, an inert gas is directed through an inert gas line 4 in the direction of the arrow *7a*, and it is connected to one or more inert gas feeder lines 1 which, in turn, lead to respective inert gas rings 8 disposed along the lower or discharge ends 2 of each downspout 3.

The rings lead to inert gas feeder lines 8*a* which are directed into the lower end of the spouts as necessary to effect the feeding of the coal.

In accordance with a feature of the invention, water is directed through spray nozzles 7 from water supply line 5 which are operated under the control of an automatic valve 9 to spray water in sprays directed in the gas flow direction *7a*. Water is supplied to the water supply line 5 by a booster pump 14 which, together with the automatic valve 9, are operated by a control or switch unit 16. Control or switch unit 16 is operated by the pressure conditions sensed by sensing line 10 connected to a pressure gauge 11 in the waste gas line 12 and which is relayed to the automatic valve through a connection 17. This line ensures the rapid reduction of overpressures, for example, above 150 mm head of water. Under standard pressures, e.g., 100 mm head of water, gases and vapors are drawn off for recleaning purposes through line 18. Line 18 includes an overpressure valve 19 and a standard valve 20 plus a temperature sensing device 21 which are installed for safety reasons.

The booster pump 14 raises the water pressure from about 0.5 bar to 10 bar.

While a specific embodiment of the invention has been shown and described in detail to illustrate the application of the principles of the invention, it will be understood that the invention may be embodied otherwise without departing from such principles.

What is claimed is:

1. A bunker for supplying coal to a plurality of charging hoppers and test bunkers of coke ovens in a coke oven battery, comprising, a bunker housing having an inlet for receiving charging coal and a lower portion with a plurality of downwardly opening coke oven discharge spouts corresponding to the number of charging hoppers and test bunkers, and an inert gas feeder line connected to the lower ends of each of said downspouts for supplying inert gas to the said discharge spouts, and means for spraying water into the inert gas line in the direction of flow of the inert gas.

2. A bunker, as claimed in claim 1, wherein said inert gas line includes a ring manifold portion disposed around the lower end of each downspout.

3. A bunker, as claimed in claim 2, wherein said means for spraying water includes a water line connected into said inert gas line and terminating in a spray nozzle directed in the direction of the inert gas flow, an automatic valve in said water line for opening and closing said line and regulating the flow therethrough, a waste water line connected out of the upper end of said coal bunker and pressure-sensing means in said waste water gas line connected to said automatic valve for operating the water for regulating the amount of water directed into the inert gas line.

* * * * *